US007401581B2

(12) United States Patent
Yamada

(10) Patent No.: US 7,401,581 B2
(45) Date of Patent: Jul. 22, 2008

(54) VARIABLE VALVE APPARATUS FOR INTERNAL COMBUSTION ENGINE

(75) Inventor: Yoshihiko Yamada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 160 days.

(21) Appl. No.: 11/369,839

(22) Filed: Mar. 8, 2006

(65) Prior Publication Data

US 2006/0201460 A1 Sep. 14, 2006

(30) Foreign Application Priority Data

Mar. 9, 2005 (JP) ..... 2005-064744

(51) Int. Cl.
*F01L 1/34* (2006.01)

(52) U.S. Cl. ..... 123/90.16; 123/90.15; 123/90.31

(58) Field of Classification Search ..... 123/90.15, 123/90.16, 90.31
See application file for complete search history.

(56) References Cited

U.S. PATENT DOCUMENTS 6,622,678 B2 * 9/2003 Shimizu et al. ..... 123/90.16
2004/0074475 A1 * 4/2004 Weiss et al. ..... 123/399

FOREIGN PATENT DOCUMENTS

JP 2001-123809 5/2001

* cited by examiner

*Primary Examiner*—Zelalem Eshete
(74) *Attorney, Agent, or Firm*—Foley & Lardner LLP

(57) ABSTRACT

A variable valve apparatus for an internal combustion engine including a cylinder set comprising a plurality of cylinders. The variable valve apparatus includes: a control shaft adapted for rotation; a valve actuating mechanism provided for each cylinder of the cylinder set and adapted to vary a valve lift characteristic of an engine valve of the each cylinder of the cylinder set in accordance with a rotational position of the control shaft; and a valve lift adjusting mechanism provided for each cylinder of a first subset of the cylinder set and adapted to adjust the valve lift characteristic of the engine valve of the each cylinder of the first subset in accordance with a standard valve lift characteristic determined in accordance with the valve lift characteristic of the engine valve of each cylinder of a second subset of the cylinder set.

24 Claims, 13 Drawing Sheets

VARIABLE VALVE APPARATUS FOR INTERNAL COMBUSTION ENGINE

BACKGROUND OF THE INVENTION

The present invention relates generally to a variable valve apparatus or system for internal combustion engine, and more particularly to a variable valve apparatus which has a valve lift adjusting mechanism for adjusting a valve operating characteristic of an engine valve set of an internal combustion engine independently of other engine valve sets of the engine.

Japanese Published Patent Application No. 2001-123809 (hereinbelow referred to as "JP2001-123809") shows such a variable valve apparatus for internal combustion engine. The variable valve apparatus of JP2001-123809 is adapted for internal combustion engines having a plurality of cylinders such as four-cylinder internal combustion engines and six-cylinder internal combustion engines. The variable valve apparatus of JP2001-123809 generally comprises: a drive shaft rotating in synchronization with a crankshaft; a drive cam provided for each cylinder and attached to the drive shaft with eccentricity to the axis of the drive shaft; two swing cams provided for each cylinder and adapted for opening and closing two intake valves of each cylinder; and a multi-articulated power transmitting mechanism provided for each cylinder and adapted for converting the eccentric rotary motion of the drive cam into a swinging motion of the swing cams. The power transmitting mechanism comprises: a rocker arm located above the swing cams and supported for swinging motion on a control shaft; a link arm linking the drive cams and one wing portion of the rocker arm; a link rod linking the swing cams and the other wing portion of the rocker arm. Specifically, the control shaft is formed as a straight member extending in the longitudinal direction of the engine, and is rotatably supported on bearings provided on an upper end of a cylinder head of the engine. The control cam is formed on the outer peripheral surface of the control shaft for each cylinder, and is adapted to serve as an axis of rotation of the swinging motion of the rocker arm. When the rotational position of each control cam is changed via the control shaft by an actuator in accordance with engine operating conditions, the axis of rotation of each rocker arm moves to vary the lift height of each intake valve. As constructed above, the foregoing variable valve apparatus comprises many parts including the many parts of the multi-articulated power transmitting mechanism. As a result, errors in machining and assembling tend to cause variations in the lift height among intake valves, especially to cause variations in the valve lift height among cylinders. In order to solve this problem, the variable valve apparatus of JP2001-123809 includes a valve lift adjusting mechanism for making an adjustment to the lift height of each intake valve. The valve lift adjusting mechanism is provided for every valve actuating mechanism comprising the above-mentioned power transmitting mechanism, or for every cylinder.

SUMMARY OF THE INVENTION

As mentioned above, the variable valve apparatus of JP2001-123809 includes a valve lift adjusting mechanism for every valve actuating mechanism or for every cylinder. This adversely affects the product cost of the variable valve apparatus.

Accordingly, it is an object of the present invention to provide a variable valve apparatus for an internal combustion engine, which is adapted to adjust a valve operating characteristic of each engine valve of the engine correctly with a low cost.

According to one aspect of the present invention, a variable valve apparatus for an internal combustion engine comprising a cylinder set comprising a plurality of cylinders, the variable valve apparatus comprises: a control shaft adapted for rotation; a valve actuating mechanism provided for each cylinder of the cylinder set and adapted to vary a valve lift characteristic of an engine valve of the each cylinder of the cylinder set in accordance with a rotational position of the control shaft; and a valve lift adjusting mechanism provided for each cylinder of a first subset of the cylinder set and adapted to adjust the valve lift characteristic of the engine valve of the each cylinder of the first subset in accordance with a standard valve lift characteristic determined in accordance with the valve lift characteristic of the engine valve of each cylinder of a second subset of the cylinder set. The second subset of the cylinder set may be the complement of the first subset of the cylinder set.

According to another aspect of the invention, a method for a variable valve apparatus for an internal combustion engine comprising a cylinder set comprising a plurality of cylinders, the variable valve apparatus comprising: a control shaft adapted for rotation; a valve actuating mechanism provided for each cylinder of the cylinder set and adapted to vary a valve lift characteristic of an engine valve of the each cylinder of the cylinder set in accordance with a rotational position of the control shaft; and a valve lift adjusting mechanism provided for each cylinder of a first subset of the cylinder set and adapted to adjust the valve lift characteristic of the engine valve of the each cylinder of the first subset, comprises: determining a standard valve lift characteristic in accordance with the valve lift characteristic of the engine valve of each cylinder of a second subset of the cylinder set; adjusting the valve lift characteristic of the engine valve of the each cylinder of the first subset in accordance with the standard valve lift characteristic; and adjusting a standard position of the control shaft in such a manner to vary the standard valve lift characteristic in accordance with a desired valve lift characteristic.

BRIEF DESCRIPTION OF THE DRAWINGS

FIG. 6A shows a valve closing operation for each set of intake valves in a minimum valve lift setting, and FIG. 6B shows a valve opening operation for the each set of intake valves in the minimum valve lift setting.

FIG. 7A shows a valve closing operation for the each set of intake valves in a maximum valve lift setting, and FIG. 7B shows a valve opening operation for the each set of intake valves in the maximum valve lift setting.

DETAILED DESCRIPTION OF THE INVENTION

Referring to the accompanying drawings, there is shown a variable valve apparatus for internal combustion engine in accordance with each embodiment of the present invention. For ease of understanding, various directional terms, such as, right, left, upper, lower, rightward and the like are used in the following description. Similarly, cylinders are numbered consecutively from one from the front to the rear of the engine as shown in FIG. 2B. However, such terms are to be understood with respect to only a drawing or drawings on which corresponding part or portion is shown. The variable valve apparatus of each embodiment is adapted for intake valves of a multi-cylinder internal combustion engine. In a first embodiment of the present invention, a variable valve apparatus is adapted to a V-type six-cylinder internal combustion engine. The drawings show one cylinder set comprising three cylinders in one bank of the engine.

Figure 1:
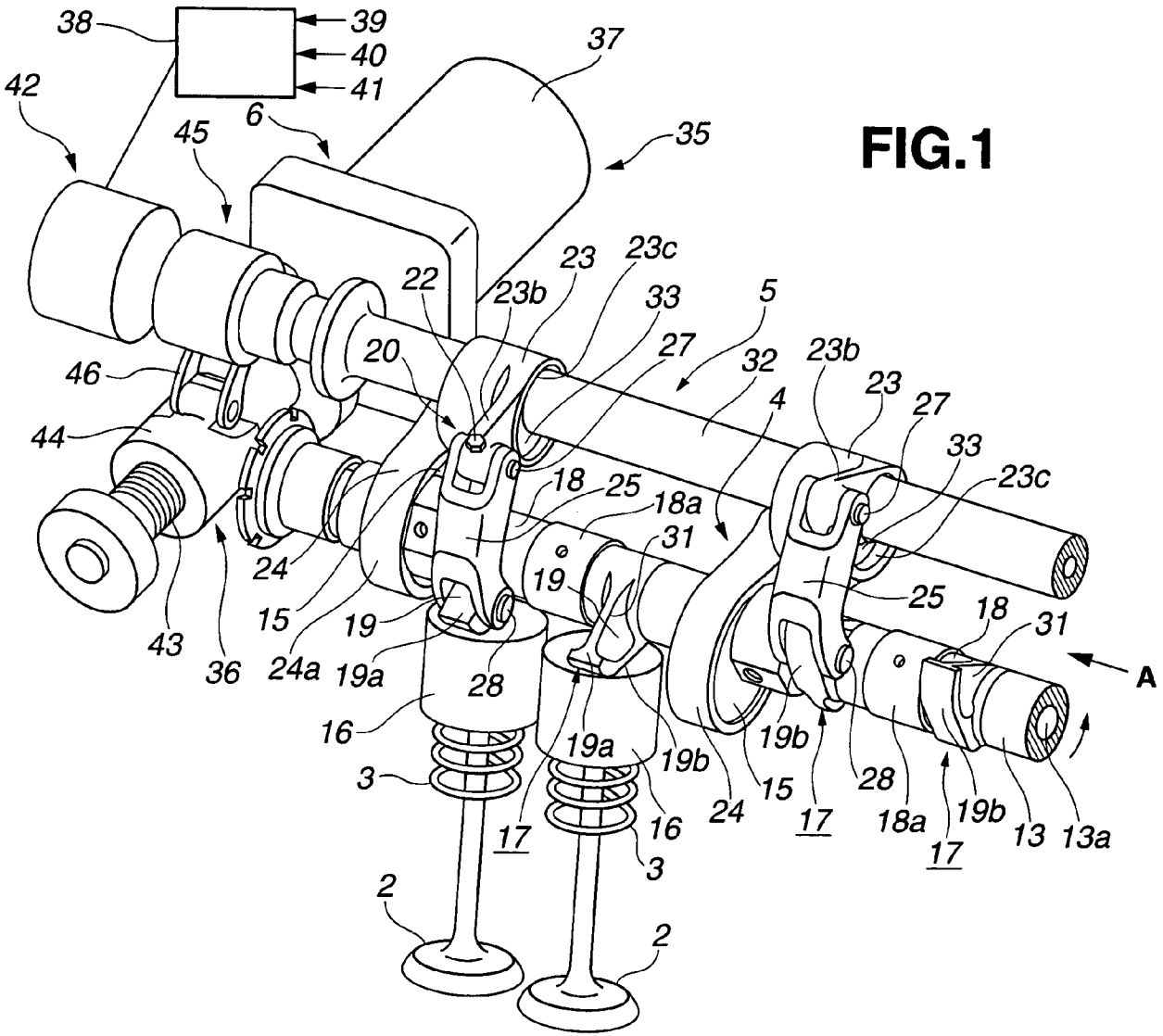
FIG. 1 is a perspective view of a portion of a variable valve apparatus for internal combustion engine in accordance with a first embodiment of the present invention.

As shown in FIG. 1, the variable valve apparatus of the first embodiment is constructed for V-type six-cylinder internal combustion engines of a type that has two intake valves 2 and 2 for each cylinder. That is, the variable valve apparatus is constructed to control operation of paired intake valves 2 and 2 (namely, engine valves) for each cylinder of the engine. Intake valves 2 and 2 are slidably guided by respective valve guides not shown of a cylinder head 1 (see FIG. 6A). Each intake valve 2 has a valve spring 3 for being biased in a closing direction (upward direction in FIG. 1), and has a valve lifter 16 mounted on a stem thereof. As described in detail hereinbelow, the variable valve apparatus generally comprises a valve actuating mechanism 4 that induces an opening/closing condition of intake valves 2 and 2, a valve lift control mechanism 5 that is incorporated with valve actuating mechanism 4 to vary a valve operating characteristic or lift characteristic such as a lift height and a working angle or operating angle of intake valves 2 and 2, and an actuator or drive mechanism 6 that actuates valve lift control mechanism 5, and more specifically, rotates a control shaft 32 of valve lift control mechanism 5 in accordance with an operating condition of the engine. It is to be noted that the working angle of engine valve 2 is an event corresponding to a period or span in terms of crank angle, that elapses from a time when the valve 2 is just opened to a time when the valve 2 is just closed in each operation cycle of the engine.

As shown in FIG. 1, valve actuating mechanism 4 comprises: a hollow drive shaft 13 that is rotatably held on an upper portion of cylinder head 1 through bearings 14 (see FIG. 6A); a drive cam 15 for each cylinder that is fixed through a fastening pin or the like to drive shaft 13 to rotate therewith; a swing cam unit 17 for each cylinder that is integrally mounted on a cylindrical camshaft 18 rotatably disposed on drive shaft 13 and operates in sliding contact with valve lifters 16 and 16 of intake valves 2 and 2 to induce an opening/closing operation of intake valves 2 and 2; and a power transmitting mechanism that is arranged between drive cam 15 and swing cam unit 17 to transmit a torque of drive cam 15 to swing cam unit 17. Actually, due to a below-mentioned linkage construction of the power transmitting mechanism, the eccentric rotary motion of drive cam 15 is converted into a swinging motion or rocking motion of swing cam unit 17.

Figure 2A:
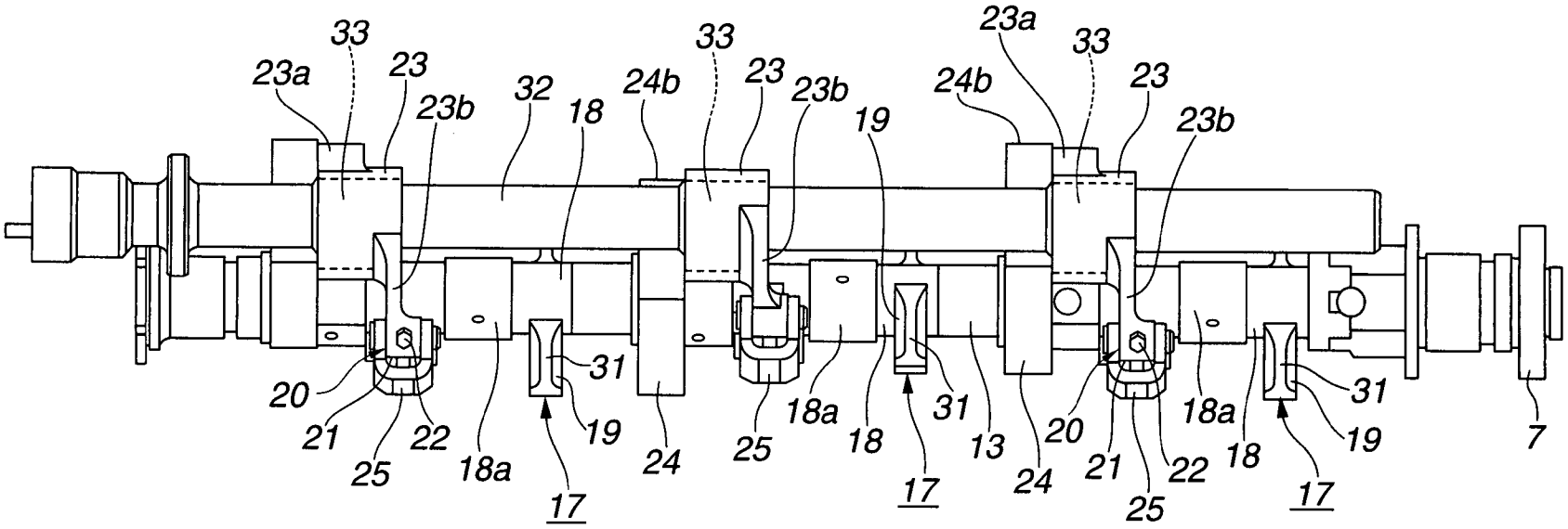
FIG. 2A is a plan view of a portion of the variable valve apparatus of the first embodiment.
Figure 2B:
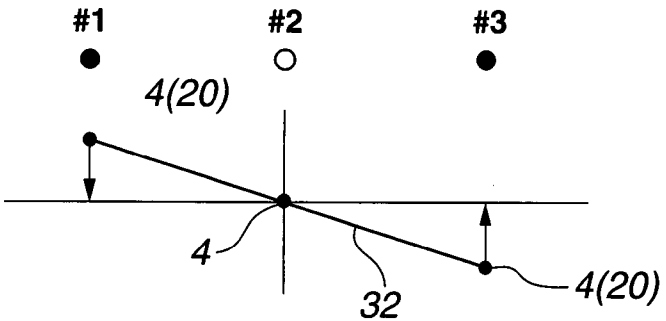
FIG. 2B is a schematic diagram showing arrangement of valve lift adjusting mechanisms in the variable valve apparatus of the first embodiment.
Figure 3B:
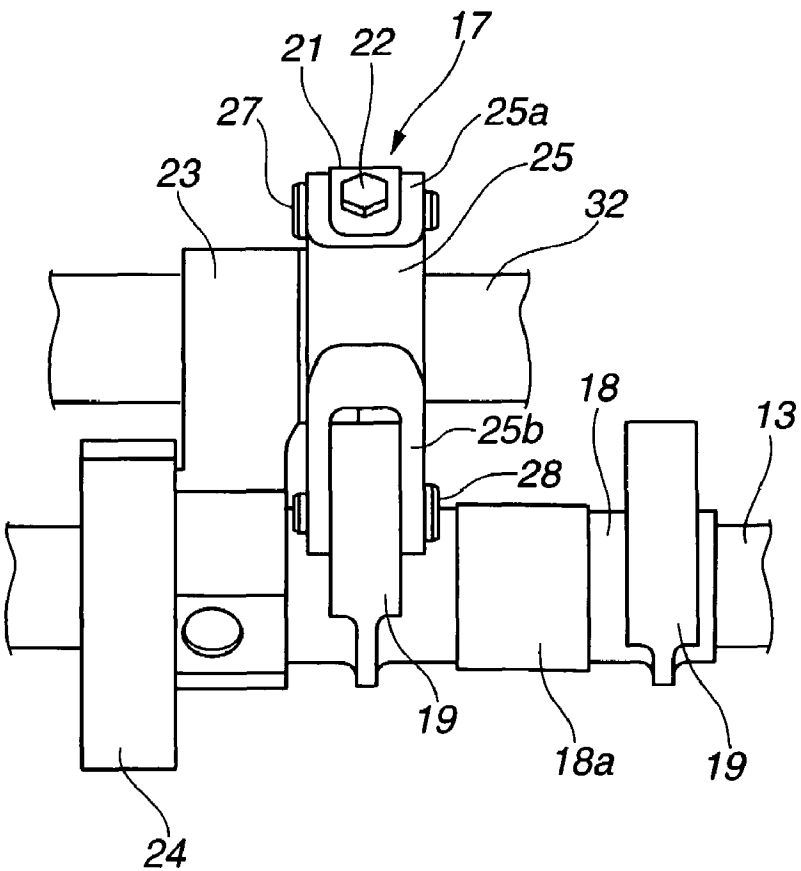
FIG. 3B is a side view of a portion of a valve actuating mechanism having a valve lift adjusting mechanism in the variable valve apparatus of the first embodiment.
Figure 3A:
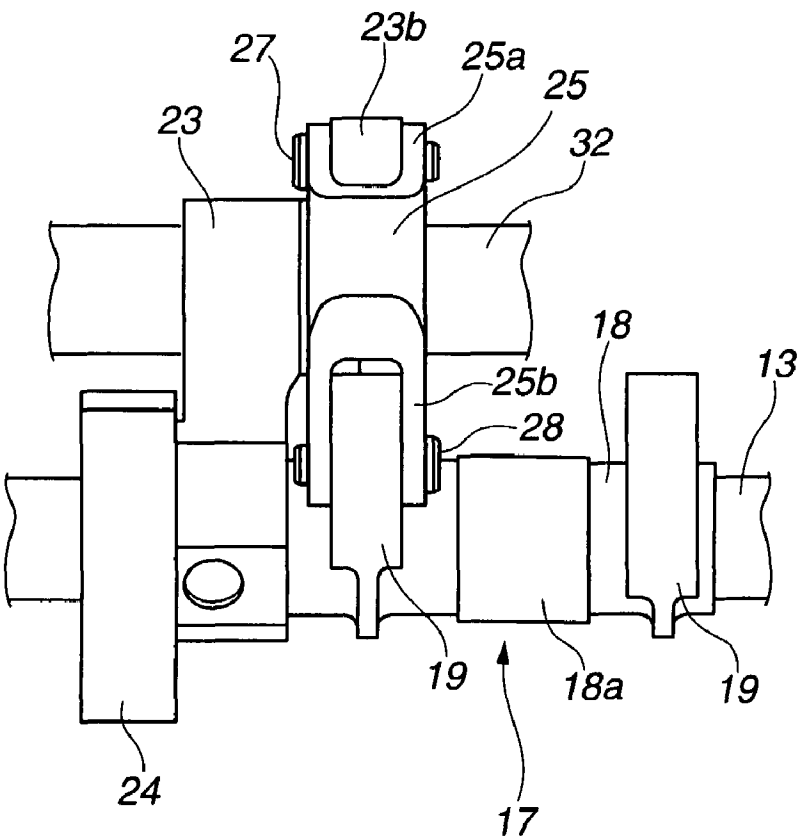
FIG. 3A is a side view of a portion of a valve actuating mechanism having no valve lift adjusting mechanism in the variable valve apparatus of the first embodiment.

As shown in FIG. 2A, drive shaft 13 extends along the longitudinal axis of the engine. Drive shaft 13 has one end to which a torque is applied from a crankshaft of the engine through a driven sprocket 7 fixed to the end of drive shaft 13 and a timing chain that is put around driven sprocket 7 and the crankshaft. That is, drive shaft 13 is driven or rotated by the crankshaft of the engine. Usually, an operation phase varying mechanism not shown is arranged between the crankshaft and drive shaft 13 for varying or controlling an operation phase of drive shaft 13 relative to the crankshaft of the engine. The direction of rotation of drive shaft 13 is shown by the curved arrow in FIG. 1. Drive shaft 13 has an oil passage 13*a* extending along its longitudinal axis and a plurality of communication holes extending in its radial direction from oil passage 13*a*. Lubricating oil is supplied to oil passage 13*a* from a main oil gallery not shown, and is supplied through the communication holes to bearings for camshaft 18 of swing cam units 17.

Figure 6A:
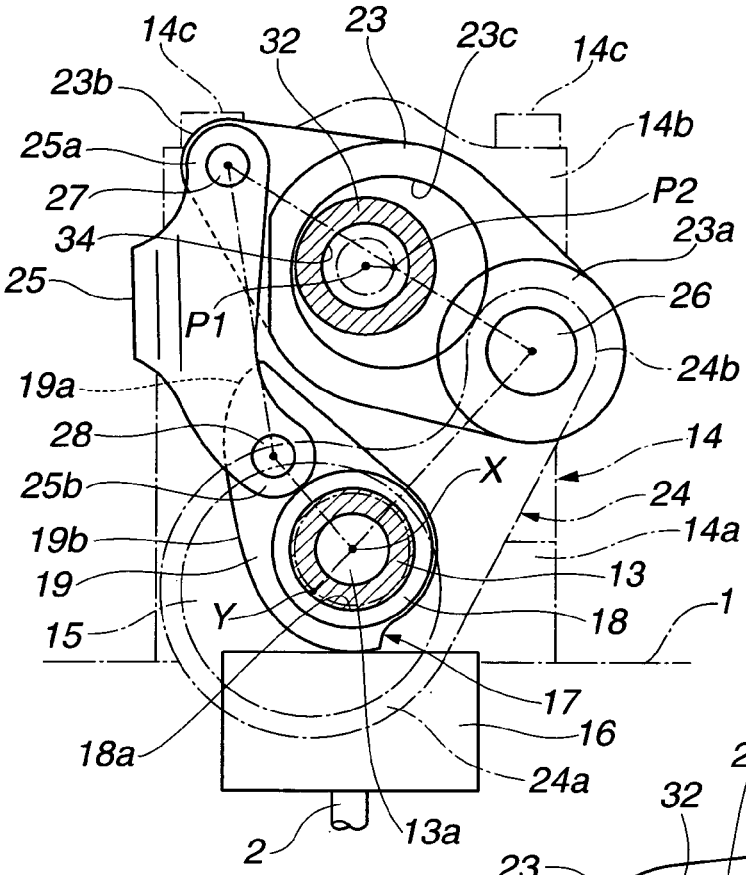
FIGS. 6A and 6B are views taken from the direction of the arrow "A" of FIG. 1, where

As shown in FIG. 6A, each of bearings 14 comprises a main bracket 14*a* that is mounted on the upper end of cylinder head 1 to rotatably support drive shaft 13 via camshaft 18, a sub-bracket 14*b* that is mounted on the upper end of main bracket 14*a* to rotatably support a below-mentioned control shaft 32, and a pair of connecting bolts 14*c* and 14*c* that pass through both sub-bracket 14*b* and main bracket 14*a* to tightly couple these brackets 14*b* and 14*a* to cylinder head 1.

As shown in FIG. 6A, drive cam 15 is a circular disc that has a center axis "Y" displaced or eccentric from a center axis "X" of drive shaft 13. More specifically, the circular disc 15 has at an eccentric portion thereof a circular opening through which drive shaft 13 passes. For the integral rotation of drive cam 15 with drive shaft 13, drive shaft 13 is secured to the circular opening of the drive cam 15 through press-fitting or the like. Each drive cam 15 is located in such a manner as not to interfere with valve lifters 16 and 16, as shown in FIG. 1.

Swing cam unit 17 is integrally formed of steel, and is swingably supported on drive shaft 13. Swing cam unit 17 comprises camshaft 18, a pair of swing cams 19 and 19. Camshaft 18 is cylindrically shaped and is rotatably fitted on the outer peripheral surface 13*a* of drive shaft 13. Camshaft 18 has a portion defining an insertion hole 18*a* through which drive shaft 13 passes, and a journal 18*b* at a substantially central position in the outer peripheral surface, which is rotatably supported on main bracket 14*a*. Each swing cam 19 has a generally triangular cross section, having a cam nose portion 19*a* radially extending and a cam surface 19*b* at its lower side. As shown in this drawing, cam surface 19*b* of each swing cam 19 includes a base round part that extends around the cylindrical outer surface of camshaft 18, a lump part that extends from the base round part toward cam nose portion 19*a*, and a lift part that extends from the lump part to a maximum lift point defined at the leading end of cam nose portion 19*a*. That is, under operation, these parts of cam surface 19*b* operate in sliding contact with an upper surface of the corresponding valve lifter 16 thereby to induce the opening/closing operation of the corresponding intake valve 2 in accordance with a swinging motion of swing cam 19. Cam surface 19*b* of each swing cam 19 is applied with a high-frequency quenching process. As shown in FIG. 1, cam nose portion 19*a* of one of swing cams 19 and 19 is linked with one end portion of a below-mentioned link rod 25 with a pivot pin 28, while each swing cam 19 has at its upper surface a narrow rib 31 radially extending, which ensures rigidity of swing cam 19 against a large load caused by the swinging motion of link rod 25 and the biasing force of valve spring 3.

Figure 4:
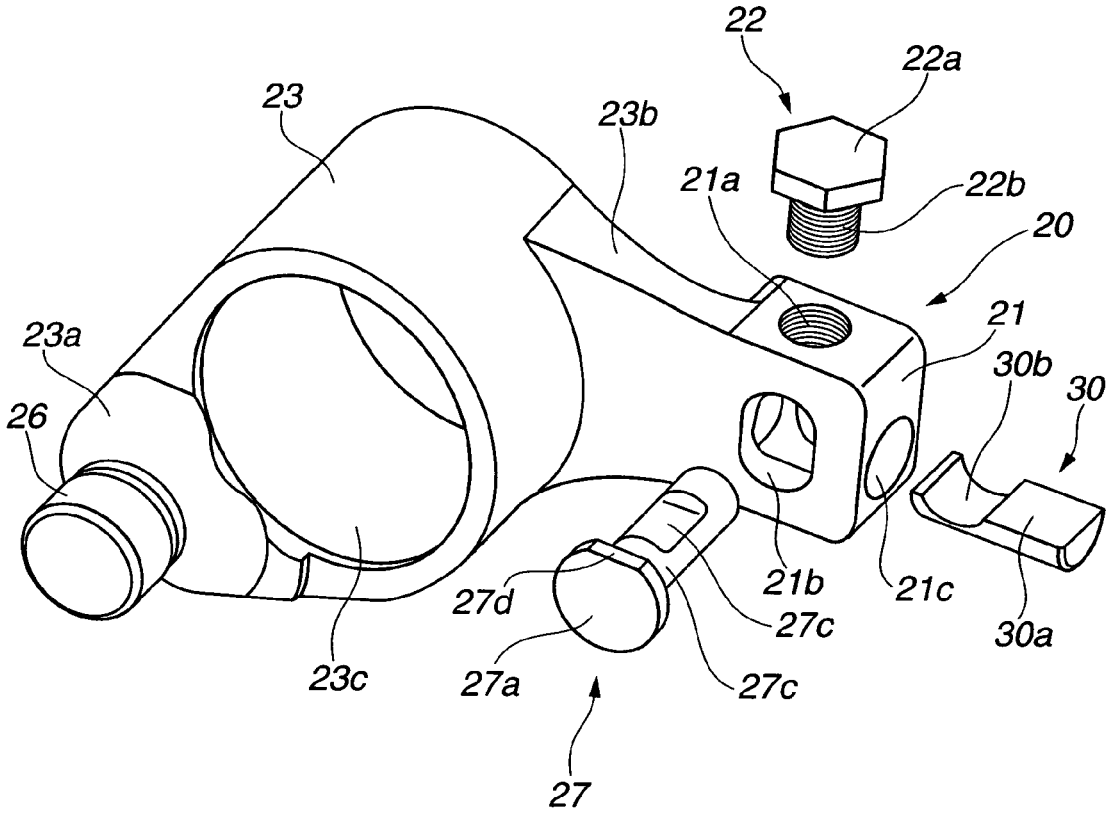
FIG. 4 is an exploded perspective view of the valve lift adjusting mechanism of the variable valve apparatus of the first embodiment.

As shown in FIGS. 1, 2, 3, 6A and 6B, the power transmitting mechanism comprises a rocker arm 23 that is pivotally disposed about control shaft 32 positioned above drive shaft 13, a link arm 24 that pivotally connects a first wing portion 23*a* of rocker arm 23 to drive cam 15, and a link rod 25 that pivotally connects a second wing portion 23*b* of rocker arm 23 to swing cam 19. As shown in FIG. 4, rocker arm 23 has at its middle portion a cylindrical bore 23*c* in which an after-mentioned control cam 33 is rotatably disposed. First wing portion 23*a* of rocker arm 23 has a pivot pin 26 through which rocker arm 23 is pivotally connected to a radially projected arm portion 24*b* of link arm 24. Second wing portion 23*b* of rocker arm 23 has a valve lift adjusting mechanism 20 pivotally connected to one end of link rod 25, valve lift adjusting mechanism 20 serving for adjusting the lift height of each intake valve 2. First and second wing portions 23*a* and 23*b* of rocker arm 23 extend radially outward from opposed end portions of the bored middle portion of rocker arm 23. As shown in FIG. 6A, link arm 24 comprises an annular base portion 24*a* that rotatably receives therein drive cam 15, and the radially projected arm portion 24*b* that is pivotally connected to first wing portion 23*a* of rocker arm 23 through pivot pin 26. As best shown in FIG. 6A, link rod 25 is a curved channel member that has an upper end 25*a* pivotally connected to second wing portion 23*b* of rocker arm 23 through pivot pin 27, and a lower end 25*b* pivotally connected to cam nose portion 19*a* of swing cam 19 through a pivot pin 28. Specifically, link rod 25 is linked with second wing portion 23*b* of rocker arm 23 through pivot pin 27 and valve lift adjusting mechanism 20.

Figure 5:
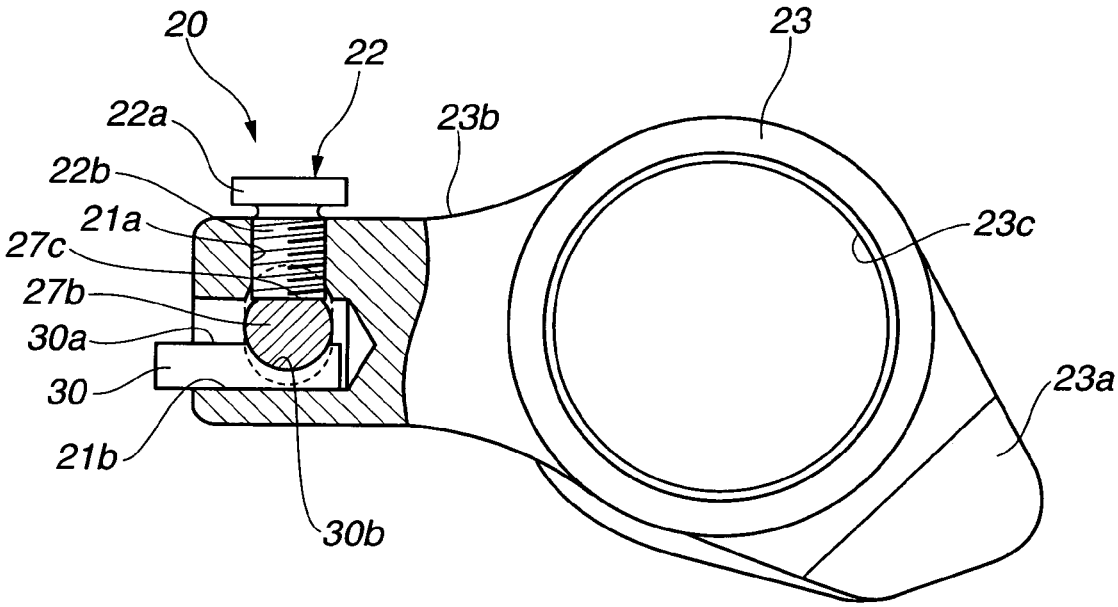
FIG. 5 is a partial sectional side view of the valve lift adjusting mechanism of the variable valve apparatus of the first embodiment.

As shown in FIGS. 1, 4, and 5, valve lift adjusting mechanism 20 comprises a linkage portion 21 of rocker arm 23, an adjusting shim 30, a pivot pin 27, and a fastening screw 22. Linkage portion 21 has a generally rectangular parallelepiped shape, formed integrally in second wing portion 23*b* of rocker arm 23. Linkage portion 21 of rocker arm 23 comprises a screw hole 21*a*, a pin insertion hole 21*b*, and a shim insertion hole 21*c*. Screw hole 21*a* extends substantially along the direction of gravity, and has an opening in the upper surface of linkage portion 21, to receive fastening screw 22 from above. Pin insertion hole 21*b* extends in parallel with the axis of support hole 23*c*, namely, extends along the direction normal to the longitudinal direction of screw hole 21*a*, and has an opening in each side surface of linkage portion 21 of rocker arm 23, to receive pivot pin 27. Shim insertion hole 21*c* has an opening in the outer surface of linkage portion 21 of rocker arm 23, extending toward the axis of support hole 23*c*, in the direction that is normal to the longitudinal axis of screw hole 21*a* and is normal to the longitudinal axis of pin insertion hole 21*b*. Fastening screw 22 has a hexagonal head 22*a*, and a threaded shank 22*b*. The tip of shank 22*b* is formed in the shape of a flat surface. Pivot pin 27 has a flange-like head 27*a* and a shank 27*b*. Shank 27*b* of pivot pin 27 has a flat portion 27*c* adapted to be in contact with the tip of fastening screw 22. Head 27*a* of pivot pin 27 has a chipped portion 27*d* which is in the same angular position as flat portion 27*c* about the longitudinal axis of shank 27*b*. Chipped portion 27*d* of pivot pin 27 serves for correctly positioning pivot pin 27 in such a manner that flat portion 27*c* faces the opening of screw hole 21*a*. Pin insertion hole 21*b* has an ellipse-like shaped cross section extending along the longitudinal axis of screw hole 21*a*, so that pivot pin 27 is movable along the longitudinal axis of screw hole 21*a* in pin insertion hole 21*b* in valve lift adjustment. Shim insertion hole 21*c* is formed in the shape of a cylinder having a flat bottom. The lowermost end of the opening of shim insertion hole 21*c* is located lower than that of pin insertion hole 21*b*. Adjusting shim 30 is a pin having a half-round cross section, namely, having a flat top surface 30*a* and a lower cylindrical surface adapted to be in contact with the lower surface of shim insertion hole 21*c*. In an inserted end portion of adjusting shim 30, a concave surface 30*b* is formed in top surface 30*a*, which is adapted to be in surface-to-surface contact with the cylindrical lower surface of shank 27*b* of pivot pin 27. The longitudinal length of adjusting shim 30 is greater than the depth of shim insertion hole 21*c*, providing a non-inserted portion of adjusting shim 30 to make it easy to replace the same with another adjusting shim. Different kinds of adjusting shims 30 are prepared beforehand, which differ in the depth of concave surface 30*b*.

As shown in FIG. 1, valve lift control mechanism 5 comprises control shaft 32 that extends in parallel with drive shaft 13 and is rotatably held by bearings 14 (see FIG. 6A), and a control cam 33 for each cylinder, which is secured to control shaft 32 to rotate therewith. As mentioned hereinabove, control cam 33 is rotatably disposed in support hole 23*c* provided in the middle portion of rocker arm 23. That is, control cam 33 serves as an axis of rotation of rocker arm 23. As described hereinabove and shown in FIGS. 1, 2A and 6A, control shaft 32 is rotatably held between main-bracket 14*a* and sub-bracket 14*b* of each bearing 14 that is tightly mounted on cylinder head 1. As shown in FIG. 6A, control cam 33 is a circular disc that has a center axis "P2" displaced or eccentric from a center axis "P1" of control shaft 32. More specifically, the circular disc 33 has at an eccentric portion thereof a circular opening through which control shaft 32 passes. For the integral rotation of control cam 33 with control shaft 32, control shaft 32 is secured to the circular opening of control cam 33 through press-fitting or the like.

As shown in FIGS. 1 to 3B, valve lift adjusting mechanism 20 is provided for each rocker arm 23 of two valve actuating mechanisms 4 which are located nearest to the ends of control shat 32. On the other hand, valve lift adjusting mechanism 20 is not provided for valve actuating mechanism 4 which is located at the middle of control shaft 32. It is noted that the solid circle indicates a cylinder having valve lift adjusting mechanism 20 while the blank circle indicates a cylinder having no valve lift adjusting mechanism 20 in FIG. 2B.

The following describes drive mechanism 6 in detail with reference to FIG. 1. As shown in FIG. 1, drive mechanism 6 generally comprises a housing not shown, an electric motor 35 that is connected to one axial end of the housing, and a ball-screw type transmission mechanism 36 that is installed in the housing for transmitting a torque of electric motor 35 to control shaft 32 while reducing the rotation speed. Electric motor 35 is of a proportional DC type which comprises a cylindrical casing 37 that has a rectangular end portion tightly connected to the open end of the housing to cover the same. Electric motor 35 is controlled by a control unit 38. That is, control unit 38 processes various information signals fed thereto, and outputs an instruction signal to electric motor 35. These information signals are, for example, signals from a crank angle sensor 39, an air flow meter 40, an engine coolant temperature sensor 41, and a potentionmeter 42 for measuring a rotational position of control shaft 32. By processing these information signals, control unit 38 derives a current operating condition of the engine, and outputs an instruction signal to electric motor 35 in accordance with the derived operating condition of the engine. Ball-screw type transmission mechanism 36 generally comprises a ball-screw shaft 43 that extends axially in the housing to be coaxially connected to the output shaft of electric motor 35, a ball nut 44 that is disposed about ball-screw shaft 43 to operatively engage with the same, a lever member 45 that is secured to one end of control shaft 32 to radially extend, and a channel shaped link member 46 that pivotally connects lever member 45 and ball nut 44. Lever member 45 and link member 46 thus constitute a transmission mechanism. Ball nut 44 is meshed with ball-screw shaft 43 so that rotation of ball-screw shaft 43 about its axis induces a forward or rearward movement of ball nut 44 along ball-screw shaft 43.

Figure 6B:
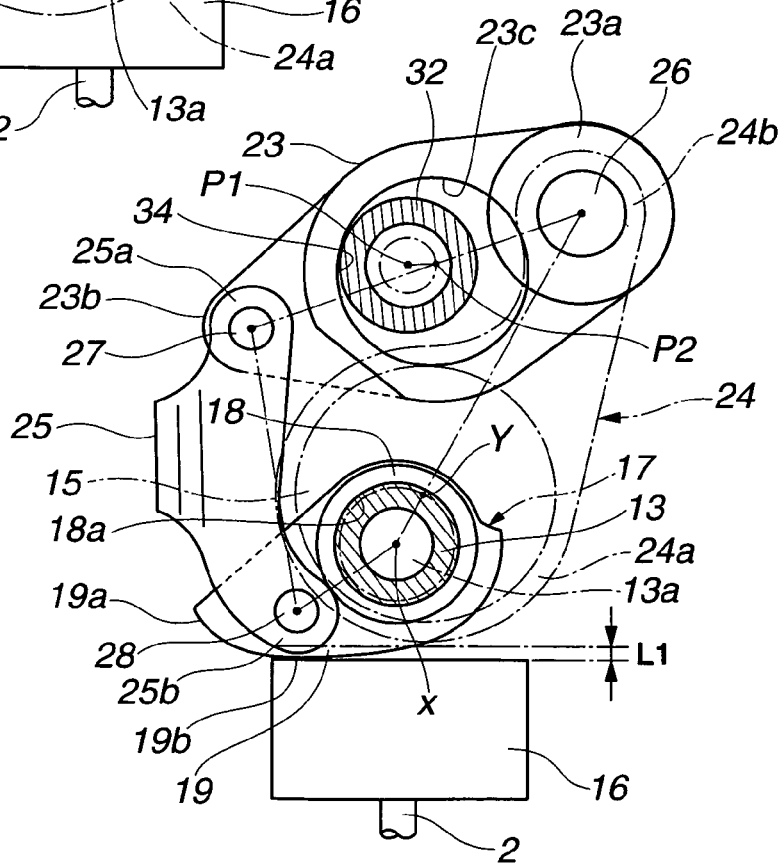
Figure 7A:
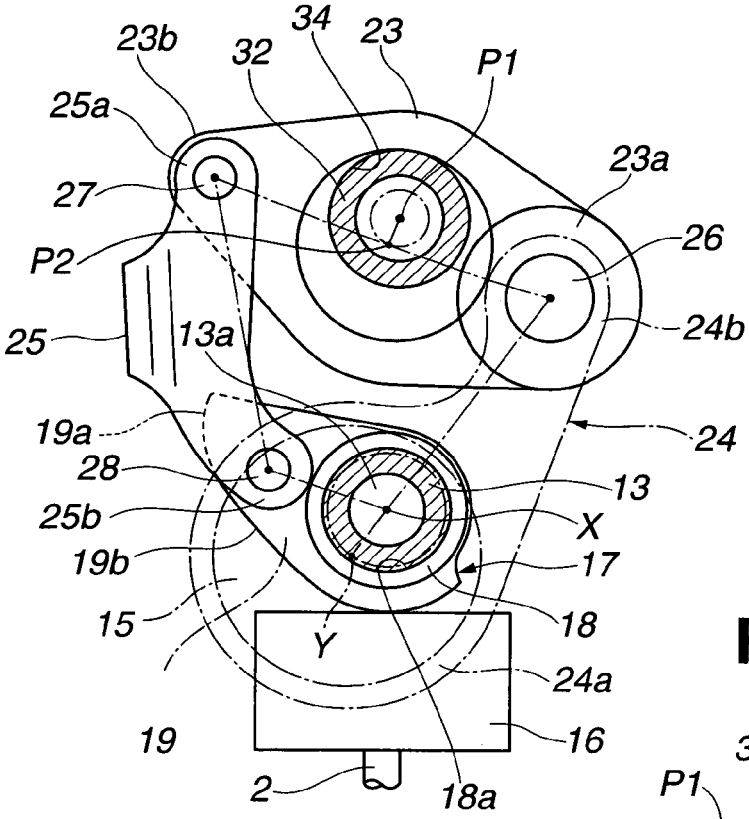
FIGS. 7A and 7B are views taken from the direction of the arrow "A" of FIG. 1, where
Figure 7B:
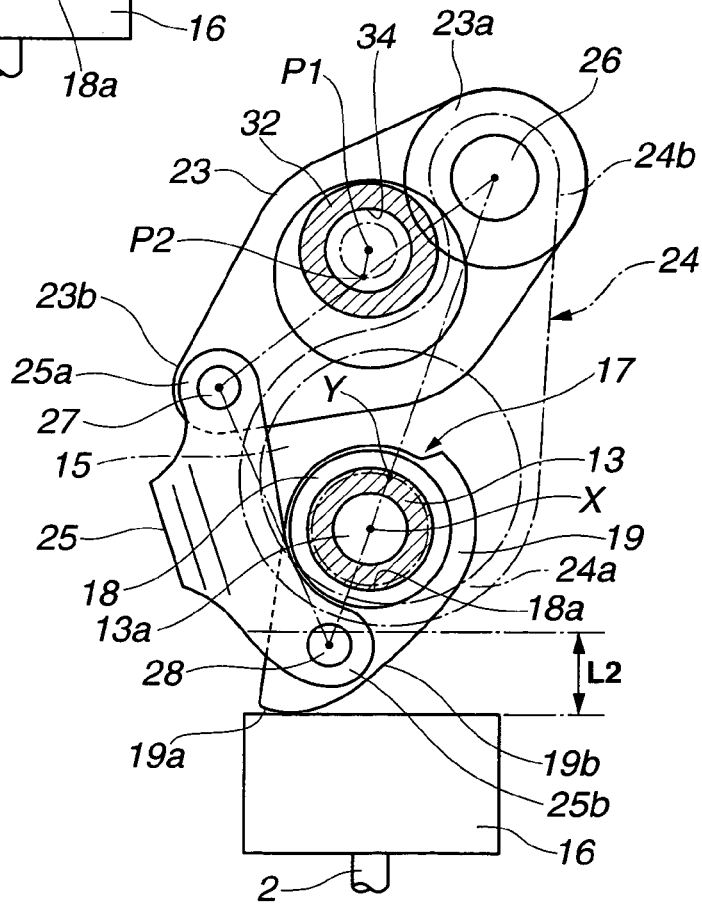
Figure 8:
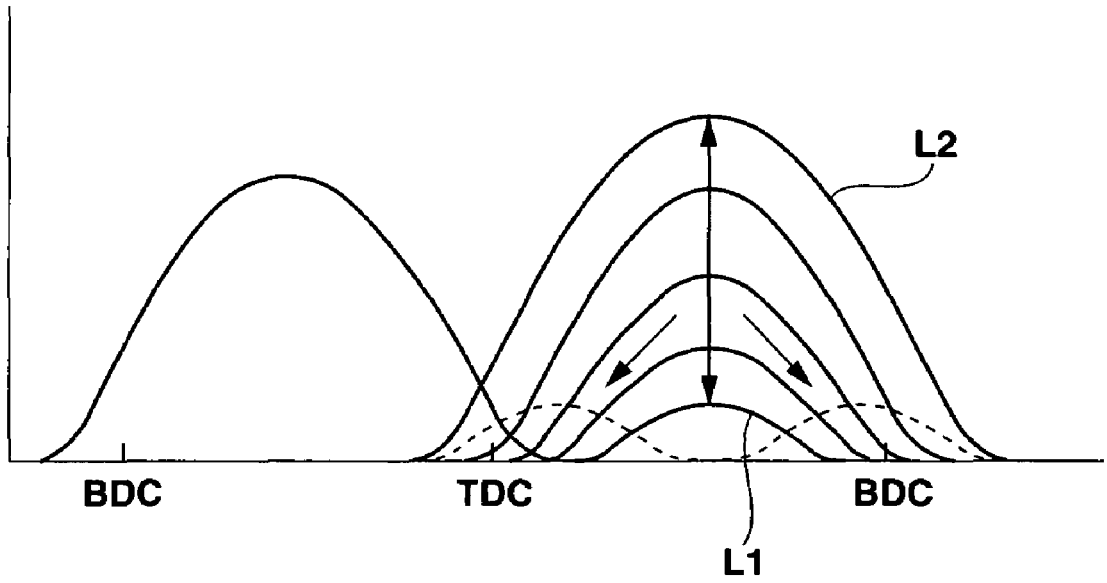
FIG. 8 is a graph showing valve operating characteristics of each intake valve, which are provided by the variable valve apparatus of the first embodiment.

The following describes operation of each valve actuating mechanism 4 for controlling the lift height of each intake valve 2 with reference to FIGS. 6A to 8. First discussed is a case where the associated engine is operating at low speeds, such as at idling. In this case, electric motor 35 is actuated in accordance with an instruction signal outputted from control unit 38. Upon this, a torque produced by electric motor 35 is transmitted to ball-screw shaft 43 to rotate the same. With this, ball nut 44 is moved axially toward electric motor 35 along ball-screw shaft 43 allowing recirculating balls to run in and along a passage that is defined by and between a spiral thread of ball nut 44 and a spiral thread of ball-screw shaft. During the movement of ball nut 44 on ball-screw shaft 43, lever member 45 and thus control shaft 32 are turned counterclockwise, where the state as shown in FIGS. 7A and 7B changes to the state as shown in FIGS. 6A and 6B. Upon this, control cam 33 secured to control shaft 32 is turned counterclockwise about the axis "P1" of control shaft 32 moving the thickest cam part thereof upward away from drive shaft 13, and finally control cam 33 takes the angular position as shown in these drawings. In other words, in this case, the whole construction of rocker arm 23 takes a relatively high position. Thus, under this condition, as shown in FIG. 6A, the uppermost position that can be taken by pivot pin 27 provided between second wing portion 23*b* of rocker arm 23 and upper end 25*a* of link rod 25 is a first position that is remote from drive shaft 13. This means that as shown in FIGS. 6A and 6B, link rod 25 and thus swing cam 19 are forced to operate at a position remote from valve lifter 16. Accordingly, when, due to rotation of drive shaft 13, drive cam 15 is rotated in annular base portion 24*a* of link arm 24, rocker arm 23 is forced to swing reciprocating link rod 25 and swing cam 19 at such a position remote from valve lifter 16. That is, as shown in FIG. 6B and the graph of FIG. 8, under this condition, the valve lift shows the minimum valve lift height "L1" inducing a retarded open timing of intake valves 2 and 2 thereby minimizing the over wrap period with the associated exhaust valves. As mentioned above, the state of conversion of the power transmitting mechanism varies in accordance with the rotational position of control shaft 32. Thus, improved fuel consumption and stable running of the engine are obtained under such lower speed condition of the engine. In FIG. 8, reference "BDC" indicates a bottom dead center and reference "TDC" indicates a top dead center.

On the other hand, when the engine is subjected to a high speed operation, control unit 38 controls electric motor 35 to run in a reversed direction. Upon this, ball nut 44 is moved on and along ball-screw shaft 43. That is, ball nut 44 is moved away from electric motor 35 allowing the recirculating balls to run in and along the passage defined by and between the spiral thread of ball nut 44 and spiral thread of ball-screw shaft 43. Accordingly, lever member 45 and thus control shaft 32 are turned clockwise, where the state as shown in FIGS. 6A and 6B changes to the state as shown in FIGS. 7A and 7B. Upon this, control cam 33 is turned clockwise about the axis "P1" of control shaft 32 moving the thickest cam part thereof downward toward drive shaft 13, and finally control cam 33 takes the angular position as shown in FIGS. 7A and 7B. In other words, in this case, the whole construction of rocker arm 23 takes a relatively low position. Thus, under this condition, as shown in FIG. 7A, the uppermost position that can be taken by pivot pin 27 is a second position that is near drive shaft 13 as compared with the above-mentioned first position. This means that as shown in FIGS. 7A and 7B, link rod 25 and thus swing cam 19 are forced to operate at a position near valve lifter 16. Accordingly, when, due to rotation of drive shaft 13, drive cam 15 is rotated in annular base portion 24*a* of link arm 24, rocker arm 23 is forced to swing reciprocating link rod 25 and swing cam 19 at such a position near valve lifter 16. That is, as shown in FIG. 7B and the graph of FIG. 8, under this condition, the valve lift shows the maximum valve lift height "L2". As shown in the graph of FIG. 8, the closing timing of each intake valve 2 is retarded in accordance with an advancement of the open timing. That is, the working angle is increased. Thus, intake air charging efficiency is increased and thus sufficient engine power is obtained in such high speed condition.

The following describes a method of adjusting the lift height of intake valves 2 and 2 of the first and third cylinders by means of each valve lift adjusting mechanism 20 in assembling the parts of the variable valve apparatus. First, the lift height of intake valves 2 and 2 of each cylinder in a minimum valve lift setting is checked or measured after assembling components, such as drive shaft 13, valve actuating mechanism 4, and valve lift control mechanism 5, via bearings 14 to cylinder head 1. A standard valve lift height is set to the minimum valve lift height of valve actuating mechanism 4 located nearest to a central portion of control shaft 32. In accordance with this standard valve lift height, valve lift adjusting mechanisms 20 and 20 for the first and third cylinders #1 and #3 are adjusted. First, link rod 25 is lifted in such a manner that upper end portion 25*a* of link rod 25 is disposed near linkage portion 21 of second wing portion 23*b* of rocker arm 23. Then, as shown in FIGS. 4 and 5, adjusting shim 30 is inserted into shim insertion hole 21*c*, and shank 27*b* of pivot pin 27 is inserted both into a pin insertion hole of link rod 25 and into pin insertion hole 21*b* of linkage portion 21 of rocker arm 23, where the cylindrical lower surface of pivot pin 27 fits the concave surface 30*b* of adjusting shim 30. After that, fastening screw 22 is screwed into screw hole 21*a* to be in contact with flat portion 27*c* of pivot pin 27, and head 22*a* of fastening screw 22 is fastened by means of tools, such as a spanner. As a result, pivot pin 27 is pressed toward adjusting shim 30, to hold adjusting shim 30 between pivot pin 27 and the inner surface of shim insertion hole 21*c*. In this arrangement, the lift height of intake valves 2 and 2 is measured. When the lift height of intake valves 2 and 2 is out of a desired range, the above assembly operation is performed again, replacing adjusting shim 30 with another one having a suitable thickness. Specifically, fastening screw 22 is loosed to travel upward, pivot pin 27 is lifted upward in pin insertion hole 21*b*, and adjusting shim 30 is pulled out with the non-inserted portion grasped. In this condition, another adjusting shim 30 is inserted into shim insertion hole 21*c* and fastened by means of fastening screw 22. In this second arrangement, pivot pin 27 is located in an upward or downward position in fastening screw 22 with respect to the position in the first arrangement, in accordance with the difference in thickness between the first adjusting shim 30 and the second adjusting shim 30. The change in the position of pivot pin 27 in pin insertion hole 21*b* induces an equivalent change in the length of link rod 25, to adjust the lift height of intake valves 2 and 2 of each cylinder to be in a uniform and optimal range.

When the minimum valve lift height of central valve actuating mechanism or non-adjustable valve actuating mechanism 4 as the standard valve lift height is deviated from a desired valve lift, an initial position or reference position of control shaft 32 is adjusted to correct the standard valve lift height.

The following describes advantages and effects produced by the above-described variable valve apparatus. First, since the above-mentioned valve lift adjusting operation is performed with holding pivot pin 27 in pin insertion hole 21*b*, the valve lift adjusting operation is easily performed by inserting and removing adjusting shim 30 through shim insertion hole 21*c* along the lateral direction of the engine and by tightening and releasing fastening screw 22 through screw hole 21*a* from above in the direction of gravity. That is, valve lift adjusting mechanism 20 is arranged to be accessible from an upper opening of cylinder head 1. The change in the thickness of adjusting shim 30 induces an equivalent change in the length of link rod 25, to adjust the lift height of intake valves 2 and 2 of each cylinder to be a desired optimal value. Second, since concave surface 30*b* of adjusting shim 30 is in surface-to-surface contact with pivot pin 27, the contact pressure between adjusting shim 30 and pivot pin 27 keeps small even when a load is applied from pivot pin 27 to adjusting shim 30. This prevents that the contact surfaces of pivot pin 27 and adjusting shim 30 are deformed due to a large load applied from pivot pin 27, resulting in looseness between pivot pin 27 and adjusting shim 30. Third, since adjusting shim 30 includes concave surface 30*b* to fit pivot pin 27, it is unnecessary for pivot pin 27 to have a concave surface in its outer peripheral surface. This ensures that the rigidity of pivot pin 27 is high enough. Forth, since fastening screw 22 serves for fastening both pivot pin 27 and adjusting shim 30, the assembling and disassembling of valve lift adjusting mechanism 20 is facilitated. Fifth, since the flat tip of fastening screw 22 is adapted to be in surface-to-surface contact with flat portion 27*c* of pivot pin 27, the contact pressure between fastening screw 22 and pivot pin 27 keeps small even when a load is applied from pivot pin 27 to fastening screw 22. This prevents that the contact surfaces of pivot pin 27 and fastening screw 22 are deformed due to a large load applied from pivot pin 27, resulting in looseness between pivot pin 27 and fastening screw 22. Sixth, at whichever rotational position fastening screw 22 is inserted into swing cam 19, the tip of fastening screw 22 can be in surface-to-surface contact with flat portion 27*c* of pivot pin 27. Seventh, since pivot pin 27 includes chipped portion 27*d* in head 27*a*, flat portion 27*c* of pivot pin 27 can be positioned to be normal to the longitudinal axis of screw hole 21*a* with reference to chipped portion 27*d* of pivot pin 27. Thus, the flat tip of fastening screw 22 can be always correctly disposed in surface-to-surface contact with flat portion 27*c* of pivot pin 27. Eighth, since valve lift adjusting mechanism 20 is not provided for the central valve actuating mechanism 4 as mentioned above, the product cost of the variable valve apparatus is reduced or minimized as compared with a case where every valve actuating mechanism 4 includes a valve lift adjusting mechanism. As shown in FIG. 2B, inclination of control shaft 32 affects the lift height of each intake valve 2, to generate variations in the lift height among intake valves 2. As a result, the valve lift height of valve actuating mechanisms 4 and 4 for the first and third cylinders #1 and #3 tend to be apart from the average, while the valve lift height of central valve actuating mechanism 4 tends to be near the average. Since valve lift adjusting mechanism 20 is provided only for valve actuating mechanisms 4 and 4 for the first and third cylinders #1 and #3, the product cost is reduced. Ninth, since the minimum lift height of intake valves 2 and 2 of each of valve actuating mechanisms 4 and 4 for the first and third cylinders #1 and #3 is adjusted in accordance with the standard valve lift height that is the valve lift height of central valve actuating mechanism 4 by means of valve lift adjusting mechanism 20, the variations in the valve lift height among cylinders is reduced or minimized. Tenth, although drive shaft 13 is subjected to large forces applied by valve springs 3 and 3 through swing cam unit 17 so that it is possible that drive shaft 13 is bended, the lift height of intake valves 2 and 2 can be accurately adjusted since drive shaft 13 serves as a common shaft for supporting swing cam units 17 for swinging motion and valve lift adjusting mechanisms 20 is mounted on the both sides of drive shaft 13.

FIGS. 9A to 11 show a second, third, and fourth embodiments of the present invention, where the arrangement of valve lift adjusting mechanisms 20 is modified based on the variable valve apparatus of the first embodiment.

Figure 9A:
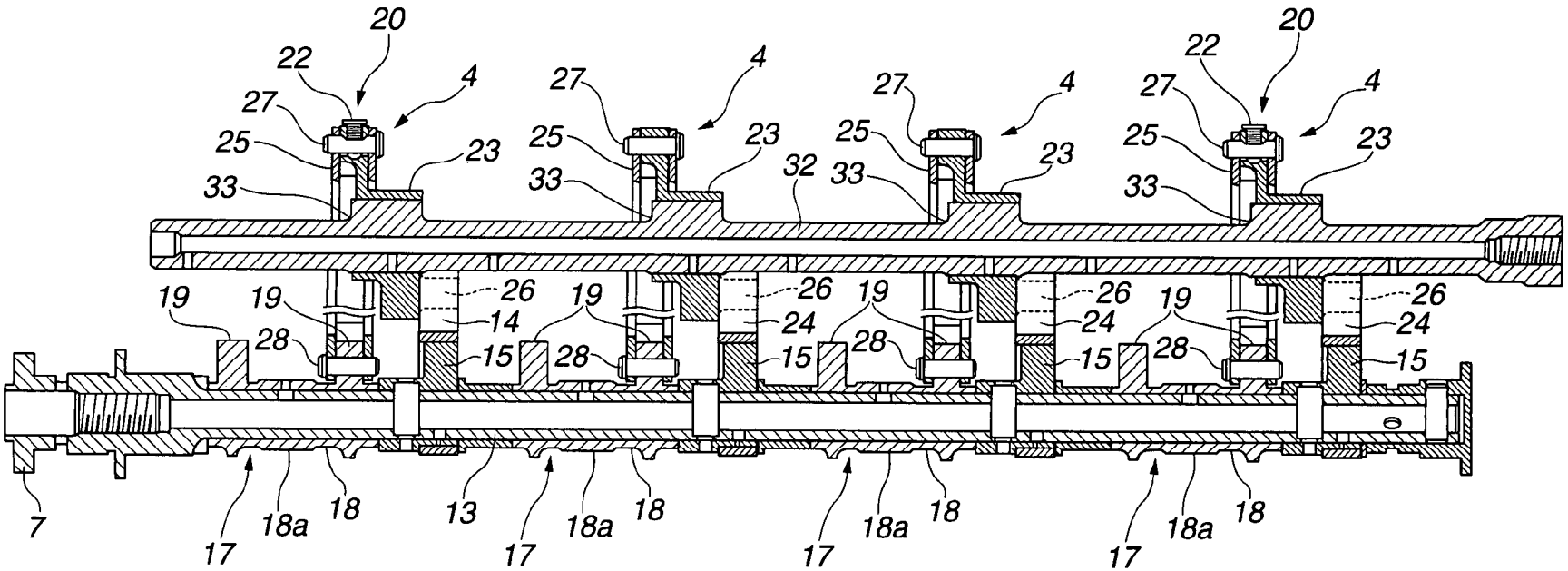
FIG. 9A is a plan view of a portion of a variable valve apparatus for internal combustion engine in accordance with a second embodiment of the present invention.
Figure 9B:
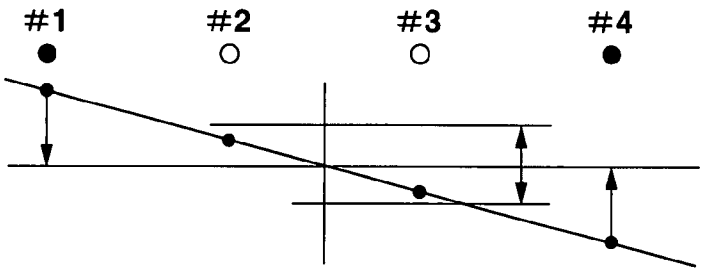
FIG. 9B is a schematic diagram showing arrangement of valve lift adjusting mechanisms in the variable valve apparatus of the second embodiment.

FIGS. 9A and 9B show a variable valve apparatus for internal combustion engine in accordance with a second embodiment of the present invention. The variable valve apparatus of the second embodiment is adapted to a V-type eight-cylinder internal combustion engine. The drawings show one cylinder set comprising four cylinders in one bank of the engine. As shown in FIG. 9A, valve lift adjusting mechanism 20 is provided for each of two valve actuating mechanisms 4 and 4 of the first and fourth cylinders #1 and #4 nearest to the front and rear ends of control shaft 32, while valve lift adjusting mechanism 20 is not provided for two valve actuating mechanisms 4 of the second and third cylinders #2 and #3 located nearest to a central portion of control shaft 32. As shown in FIG. 9B, flexure of control shaft 32 affects the lift height of each intake valve 2, to generate variations in the lift height among intake valves 2. As a result, the valve lift height of valve actuating mechanisms 4 and 4 for the first and fourth cylinders #1 and #4 tend to be apart from the average, while the valve lift height of central valve actuating mechanisms 4 and 4 tend to be near the average. In the second embodiment, since valve lift adjusting mechanism 20 is provided only for valve actuating mechanisms 4 and 4 for the first and fourth cylinders #1 and #4, the product cost is reduced while reducing the variations in the valve lift height among cylinders. In the second embodiment, the valve lift height of each valve lift adjusting mechanism 20 of the first and fourth cylinders #1 and #4 is adjusted in accordance with a standard valve lift height that is the average (or an intermediate value) of the valve lift heights of two valve actuating mechanisms 4 of the second and third cylinders #2 and #3. This smooth the variations in the valve lift height among cylinders.

Figure 10:
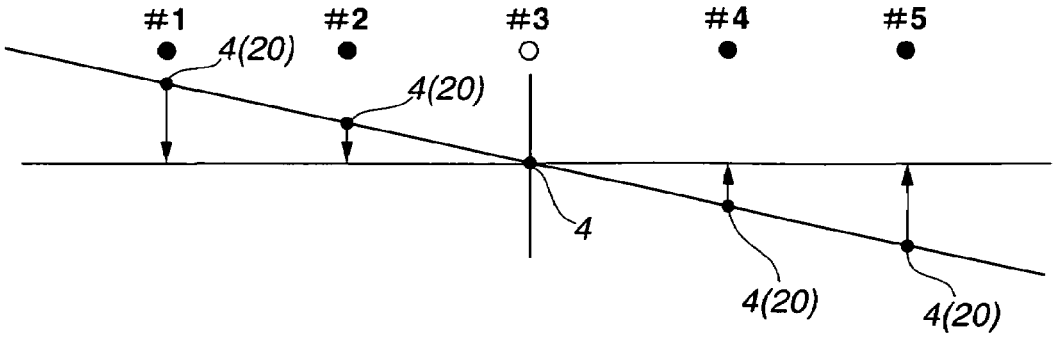
FIG. 10 is a schematic diagram showing arrangement of valve lift adjusting mechanisms in a variable valve apparatus for internal combustion engine in accordance with a third embodiment of the present invention.

FIG. 10 is a schematic diagram showing arrangement of valve lift adjusting mechanisms in a variable valve apparatus for internal combustion engine in accordance with a third embodiment of the present invention. The variable valve apparatus of the third embodiment is adapted to a V-type ten-cylinder internal combustion engine. The drawings show one cylinder set comprising five cylinders in one bank of the engine. As shown in FIG. 10, valve lift adjusting mechanism 20 is provided for each of four valve actuating mechanisms 4 of the first, second, fourth, and fifth cylinders #1, #2, #4, and #5 nearer to the front and rear ends of control shaft 32, while valve lift adjusting mechanism 20 is not provided for valve actuating mechanism 4 of the third cylinder #3 located in the center of control shaft 32. As shown in FIG. 10, flexure of control shaft 32 affects the lift height of each intake valve 2, to generate variations in the lift height among intake valves 2. As a result, the valve lift height of valve actuating mechanisms 4 and 4 of the first and fifth cylinders #1 and #5 tend to be apart from the average, while the valve lift height of valve actuating mechanism 4 of the third cylinder #3 tends to be near the average. In the third embodiment, since valve lift adjusting mechanism 20 is provided only for valve actuating mechanisms 4 of the cylinders #1, #2, #4, and #5, the product cost is reduced while reducing the variations in the valve lift height among cylinders.

The variable valve apparatus of the third embodiment may be modified as valve lift adjusting mechanism 20 is provided for each of two valve actuating mechanisms 4 and 4 of the first and fifth cylinders #1 and #5 nearest to the front and rear ends of control shaft 32, while valve lift adjusting mechanism 20 is not provided for valve actuating mechanisms 4 of the second to fourth cylinder #2 to #4 located in the center of control shaft 32. In this modification, the product cost is further reduced. As compared with the third embodiment, the machining accuracy of the components is enhanced in order to enhance the accuracy of the valve lift heights of valve actuating mechanisms 4 having no valve lift adjusting mechanism 20.

Figure 11:
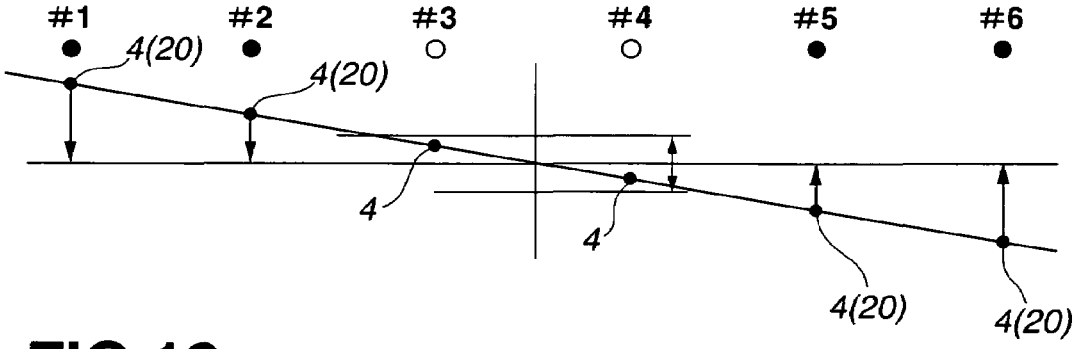
FIG. 11 is a schematic diagram showing arrangement of valve lift adjusting mechanisms in a variable valve apparatus for internal combustion engine in accordance with a fourth embodiment of the present invention.

FIG. 11 is a schematic diagram showing arrangement of valve lift adjusting mechanisms in a variable valve apparatus for internal combustion engine in accordance with a fourth embodiment of the present invention. The variable valve apparatus of the fourth embodiment is adapted to a V-type twelve-cylinder internal combustion engine. The drawings show one cylinder set comprising six cylinders in one bank of the engine. As shown in FIG. 11, valve lift adjusting mechanism 20 is provided for each of four valve actuating mechanisms 4 of the first, second, fifth, and sixth cylinders #1, #2, #5, and #6 nearer to the front and rear ends of control shaft 32, while valve lift adjusting mechanism 20 is not provided for two valve actuating mechanisms 4 of the third and fourth cylinders #3 and #4 located nearest to a central portion of control shaft 32. As shown in FIG. 11, flexure of control shaft 32 affects the lift height of each intake valve 2, to generate variations in the lift height among intake valves 2. As a result, the valve lift height of valve actuating mechanisms 4 of the first, second, fifth, and sixth cylinders #1, #2, #5, and #6 tend to be apart from the average, while the valve lift height of valve actuating mechanisms 4 of the third and fourth cylinders #3 and #4 tend to be near the average. Since valve lift adjusting mechanism 20 is provided only for valve actuating mechanisms 4 of the cylinders #1, #2, #5, and #6, the product cost is reduced while reducing the variations in the valve lift height among cylinders. The valve lift height of each valve lift adjusting mechanism 20 of the cylinders #1, #2, #5, and #6 is adjusted in accordance with a standard valve lift height that is the average (or an intermediate value) of the valve lift heights of two valve actuating mechanisms 4 of the second and third cylinders #3 and #4. This smooth the variations in the valve lift height among cylinders.

The variable valve apparatus of the fourth embodiment may be modified as valve lift adjusting mechanism 20 is provided for each of two valve actuating mechanisms 4 and 4 of the first and sixth cylinders #1 and #6 nearest to the front and rear ends of control shaft 32, while valve lift adjusting mechanism 20 is not provided for valve actuating mechanisms 4 of the second to fifth cylinder #2 to #5 located in the center of control shaft 32. In this modification, the product cost is further reduced. As compared with the fourth embodiment, the machining accuracy of the components is enhanced in order to enhance the accuracy of the valve lift heights of valve actuating mechanisms 4 having no valve lift adjusting mechanism 20.

Figure 12:
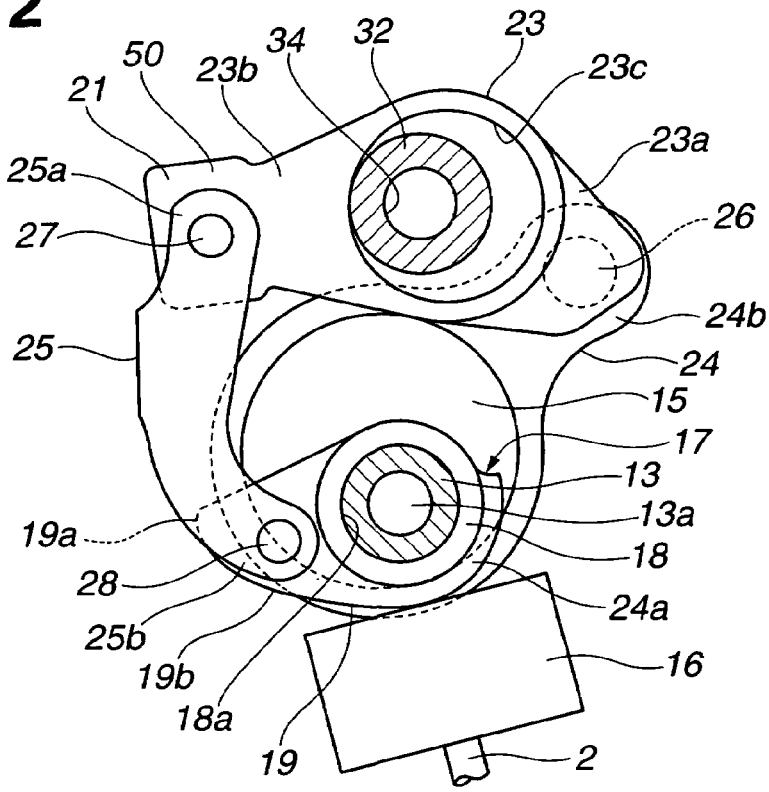
FIG. 12 is a side view of a portion of a variable valve apparatus for internal combustion engine in accordance with a fifth embodiment of the present invention, where the variable valve apparatus includes a weight adjusting element.

FIG. 12 is a side view of a variable valve apparatus for internal combustion engine in accordance with a fifth embodiment of the present invention constructed based on the first embodiment, where valve actuating mechanism 4 having no valve lift adjusting mechanism 20 includes a weight adjusting element 50 for adjusting a difference in the valve lift height caused due to a difference in weight among valve actuating mechanisms 4 under high-speed conditions of the engine. Weight adjusting element 50 is substantially identical in weight to valve lift adjusting mechanism 20. Weight adjusting element 50 serves for increasing the weight of linkage portion 21 of second wing portion 23*b* of rocker arm 23. The whole construction of rocker arm 23 is formed of a metal such as iron. Weight adjusting element 50 is implemented by expanding the rectangular cross section of linkage portion 21 of rocker arm 23 as compared with that in the first embodiment, to adjust the whole weight of the components of rocker arm 23 to be identical to the whole weight of rocker arm 23 having valve lift adjusting mechanism 20. This adjusts the inertial mass of each valve actuating mechanism 4 to be substantially same, and especially adjusts the inertial force of valve actuating mechanism 4 to be substantially same at high speed conditions of the engine. Without weight adjustment, while the engine is running at high speeds, the lift height of intake valves 2 and 2 tends to increase due to an increase in the inertial mass of valve actuating mechanism 4 caused by providing valve lift adjusting mechanism 20. In the fifth embodiment, due to weight adjusting element 50 that is provided for central valve actuating mechanism 4 having no valve lift adjusting mechanism 20, the inertial force is comparable to valve actuating mechanism 4 having valve lift adjusting mechanism 20 while the engine is running at high speeds. This reduces or minimizes the variations in the valve lift height among cylinders while the engine is running at high speeds.

Figure 13:
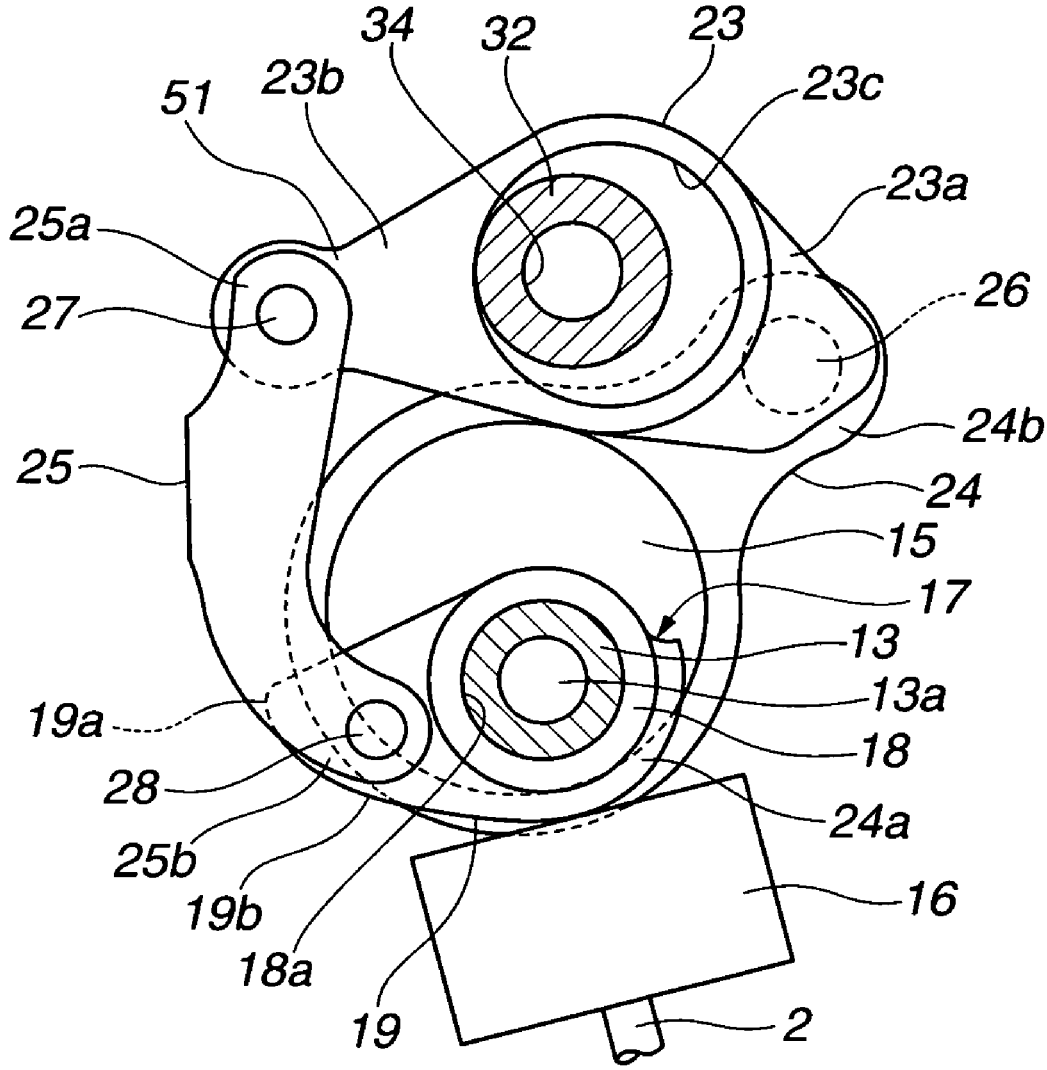
FIG. 13 is a side view of a portion of a variable valve apparatus for internal combustion engine in accordance with a sixth embodiment of the present invention, where the variable valve apparatus includes a flexure adjusting element.

FIG. 13 is a side view of a variable valve apparatus for internal combustion engine in accordance with a sixth embodiment of the present invention constructed based on the first embodiment, where valve actuating mechanism 4 having no valve lift adjusting mechanism 20 includes a flexure adjusting element for adjusting a difference in the valve lift height caused due to a difference in weight among valve actuating mechanisms 4 under high-speed conditions of the engine. The flexure adjusting element serves for increasing the up-and-down movement of second wing portion 23*b* of rocker arm 23. Specifically, rocker arm 23 is formed of a metal such as iron in such a manner that second wing portion 23*b* is constricted at the end of linkage portion 21 as compared with rocker arm 23 having valve lift adjusting mechanism 20. This constriction 51 serves as an axis of rotation of up-and-down motion of the tip of second wing portion 23*b* while the engine is running at high speeds. In the sixth embodiment, while the engine is running at high speeds, valve actuating mechanism 4 of the second cylinder #2 is subjected to an inertial force which causes second wing portion 23*b* slightly bends to expand or increase the lift height of the associated intake valves 2 and 2. Thus, the valve lift when the engine is running at high speeds is adjusted without increase in the weight of valve actuating mechanism 4 having no valve lift adjusting mechanism 20.

In a variation of the first embodiment, valve lift adjusting mechanism 20 is provided for valve actuating mechanisms 4 except valve actuating mechanism 4 nearest to drive mechanism 6. The valve lift height of each valve actuating mechanism 4 having valve lift adjusting mechanism 20 is adjusted in accordance with a standard valve lift height that is the valve lift height of valve actuating mechanism 4 having no valve lift adjusting mechanism 20. When rotation of control shaft 32 is controlled by drive mechanism 6, control shaft 32 is twisted in such a manner that the amount of displacement of the portion nearer to drive mechanism 6 is smaller while the amount of displacement of the portion farer from drive mechanism 6 is larger. This causes variations in the lift height of intake valves 2 and 2. If the standard valve lift height is set to the valve lift height of valve actuating mechanism 4 far from drive mechanism 6, it is possible that the valve lift height of each valve actuating mechanism 4 as a whole deviates from a desired lift valve lift in one direction. In this variation of the first embodiment, since the standard valve lift height that is set to the valve lift height of valve actuating mechanism 4 nearest to drive mechanism 6, the deviation of the valve lift height is reduced or minimized.

In another variation of the first embodiment, valve lift adjusting mechanism 20 is provided for valve actuating mechanisms 4 except valve actuating mechanism 4 nearest to driven sprocket 7. The valve lift height of each valve actuating mechanism 4 having valve lift adjusting mechanism 20 is adjusted in accordance with a standard valve lift height that is the valve lift height of valve actuating mechanism 4 having no valve lift adjusting mechanism 20. When valve actuating mechanism 4 far from driven sprocket 7 mounted on the end of drive shaft 13 is applied with a force by valve springs 3 and 3 biasing intake valves 2 and 2 in the closing direction, the basic position of valve actuating mechanism 4 changes to change the valve lift height. If the standard valve lift height is set to the valve lift height of valve actuating mechanism 4 far from driven sprocket 7, it is possible that the valve lift height of each valve actuating mechanism 4 as a whole deviates from a desired lift valve lift in one direction. In this variation of the first embodiment, since the standard valve lift height that is set to the valve lift height of valve actuating mechanism 4 nearest to driven sprocket 7, the deviation of the valve lift height is reduced or minimized.

Figure 14:
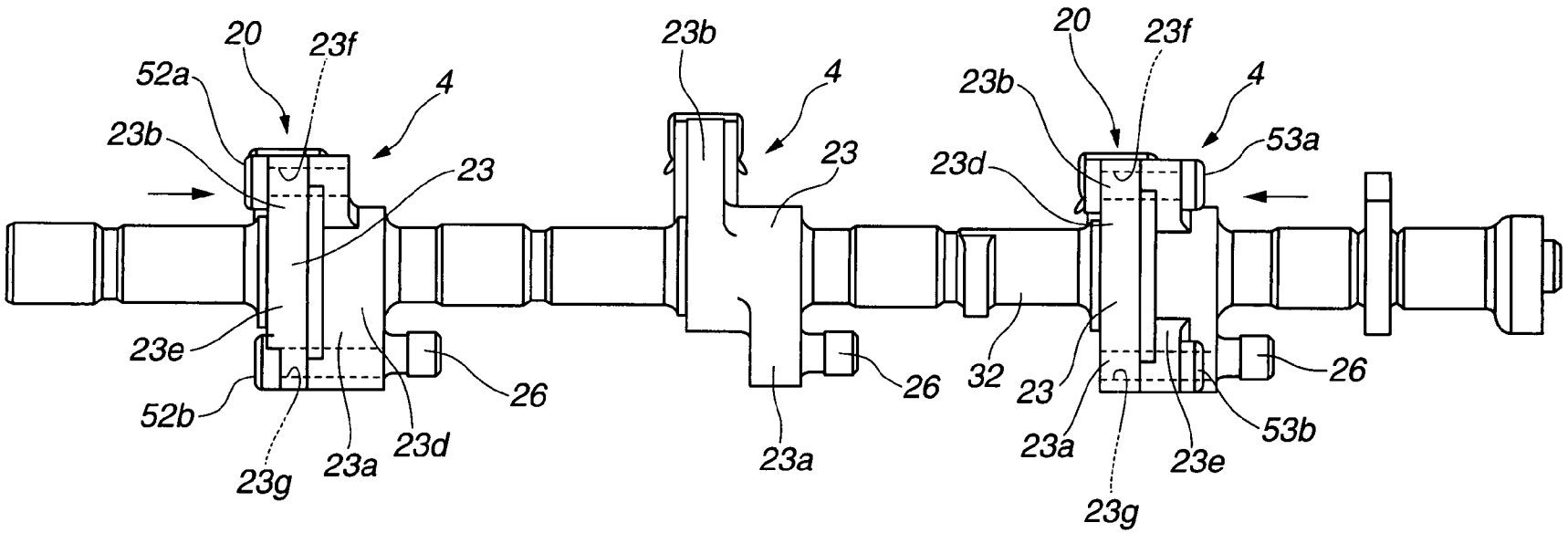
FIG. 14 is a plan view of a portion of a variable valve apparatus for internal combustion engine in accordance with a seventh embodiment of the present invention.
Figure 15A:
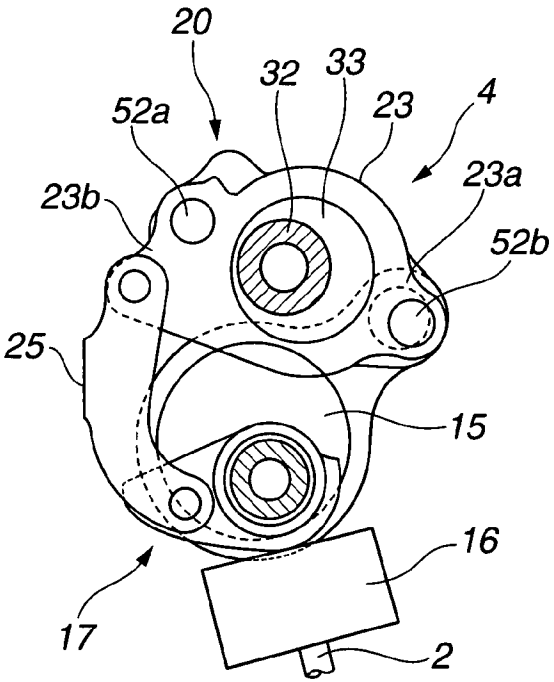
FIG. 15A is a side view of a valve actuating mechanism located nearest to the front of the engine (on the left side of FIG. 14), taken from the direction of the left arrow of FIG. 14.
Figure 15B:
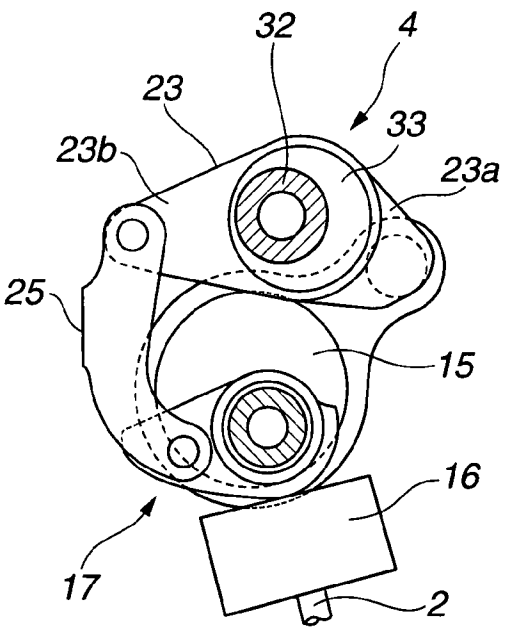
FIG. 15B is a side view of a valve actuating mechanism located in the middle of the engine (in the center of FIG. 14), taken from the direction of the left arrow of FIG. 14.
Figure 15C:
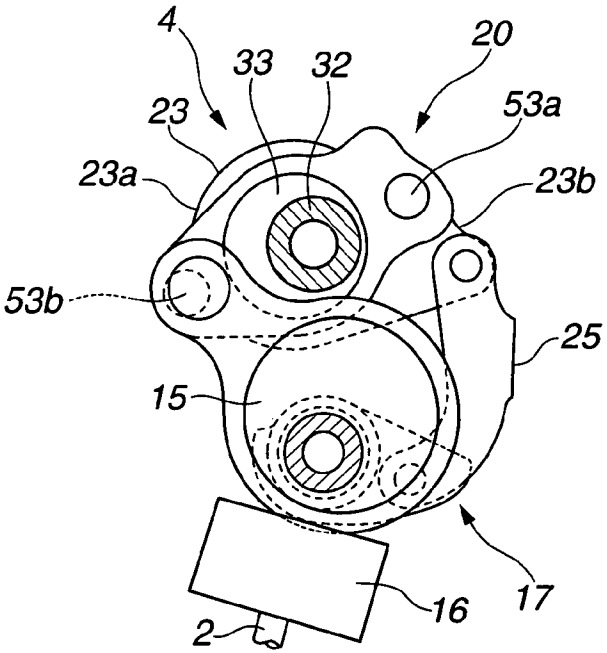
FIG. 15C is a side view of a valve actuating mechanism located nearest to the rear of the engine (on the right side of FIG. 14), taken from the direction of the right arrow of FIG. 14.

FIGS. 14 to 15C show a variable valve apparatus for internal combustion engine in accordance with a seventh embodiment of the present invention constructed based on the first embodiment. In this embodiment, rocker arm 23 and valve lift adjusting mechanism 20 are modified in such a manner that valve lift adjusting mechanism 20 is arranged to be accessible and adjusted from the front and rear of the engine. Specifically, central valve actuating mechanism 4 having no valve lift adjusting mechanism 20 is adjusted as a standard, while each rocker arm 23 of valve actuating mechanisms 4 near to the longitudinal ends of the engine comprises a front and rear split parts 23*d* and 23*e* which are rotatably supported on control cam 33 of control shaft 32. The front and rear split parts 23*d* and 23*e* of rocker arm 23 are adapted for relative rotation. The front and rear split parts 23*d* and 23*e* of rocker arm 23 have bolt holes 23*f* and 23*g*, respectively, which extend along control shaft 32. The cross section of bolt hole 23*f* formed in second wing portion 23*b* of rocker arm 23 is shaped in the form of a slot curbed along the swinging motion of rocker arm 23. The front and rear split parts 23*d* and 23*e* of rocker arm 23 of valve actuating mechanism 4 nearest to the front end of the engine are coupled by means of bolts 52*a* and 52*b* screwed into bolt holes 23*f* and 23*g* from the front of the engine (rightward direction in FIG. 14). The front and rear split parts 23*d* and 23*e* of rocker arm 23 of valve actuating mechanism 4 nearest to the rear end of the engine are coupled by means of bolts 53*a* and 53*b* screwed into bolt holes 23*f* and 23*g* from the rear of the engine (leftward direction in FIG. 14). When combining the front and rear split parts 23*d* and 23*e* of rocker arm 23 with bolts 52*a* to 53*b*, the rotational positions of the front and rear split parts 23*d* and 23*e* are displaced from each other at bolt holes 23*f* and 23*f* in order to adjust the valve lift height. Thus, valve lift adjusting mechanism 20 of this embodiment comprises the front and rear split parts 23*d* and 23*e*, and bolt holes 23*f* and 23*f*. As mentioned above, the adjusting operation can be easily performed from the front and rear sides of the engine after assembling the components of the variable valve apparatus.

In one point of view, the standard valve lift height may be set to the valve lift height of valve actuating mechanism 4 nearest to one end of control shaft 32. When a plurality of control cams 33 are formed in control shaft 32, the machining operation is performed from one end of control shaft 32 to the other end of control shaft 32. As a result, it is possible that the rotational position of control cam 33 with respect to control shaft 32 increasingly deviate from a standard. The deviation of the valve lift height of valve actuating mechanism 4 nearest to one end of control shaft 32 from a desired valve lift height is small. Accordingly, when adjusting the valve lift heights of the engine valves by means of valve lift adjusting mechanisms 20 in accordance with a standard valve lift height that is the valve lift height of valve actuating mechanism 4 nearest to one end of control shaft 32, the reference position of control cam 33 does not shift largely. That is, the basic position of each valve actuating mechanism 4 does not shift largely. Accordingly, the influence on the valve operating characteristics of each engine valve is reduced or minimized.

Although in the foregoing embodiments rotation of control shaft 32 is controlled by drive mechanism 6 including electric motor 35 and ball-screw mechanism 36, drive mechanism 6 may be a hydraulic rotation actuator.

Although in the foregoing embodiments the valve lift height is continuously varied by controlling rotation of control cam 33, i.e. by controlling rotation of control shaft 32, the valve lift may be varied stepwise.

Although in the foregoing embodiments swing cam unit 17 is supported on drive shaft 13, swing cam unit 17 may be supported on another shaft. Further, valve actuating mechanism 4 may be constructed in such a manner that the axis of rotation of a swing cam is moved instead of moving the axis of rotation of a rocker arm.

Valve lift adjusting mechanism 20 is not limited to the foregoing embodiments, and may be constructed in such a manner that an adjusting screw is used to adjust the length of link rod 25. Further, the valve lift may be adjusted by a process in which the components are disassembled, valve lift adjusting mechanism 20 is adjusted, and the components are re-assembled.

The process of adjusting the valve lift height of each valve actuating mechanism 4 to the standard valve lift height, and the process of adjusting the standard valve lift height to the desired valve lift height may be performed in an arbitrary order. When the deviation of the standard valve lift height from the desired valve lift height is considered to be small, for example, when the valve lift height of valve actuating mechanism 4 located at the center of the engine is used as the standard valve lift height, the process of adjusting the standard valve lift height to the desired valve lift height may be skipped.

The variable valve apparatus of the foregoing embodiments is not limited to V-type engines, but is applicable to straight type engines, such as, straight four-cylinder or six-cylinder engines, or flat type engines.

In the foregoing embodiments, when the variable valve apparatus includes a plurality of valve actuating mechanisms 4 having no valve lift adjusting mechanism 20, the standard valve lift height is intermediate among the valve lift heights of valve actuating mechanisms 4 having no valve lift adjusting mechanism 20, and specifically, is substantially the average of them. For example, when the variable valve apparatus includes three or more valve actuating mechanisms 4 having no valve lift adjusting mechanism 20, the standard valve lift height may be any other value between the maximum and the minimum.

The means for adjusting the valve lift when the engine is running at high speeds, or high-speed valve lift adjusting element such as the weight adjusting element and the flexure adjusting element in the foregoing embodiments, may be any other element that is provided in valve actuating mechanism 4 for increasing the valve lift height due to the inertial force in operation.

The variable valve apparatus of the foregoing embodiments may be applied to exhaust valves and applied to both intake valves and exhaust valves.

This application is based on a prior Japanese Patent Application No. 2005-64744 filed on Mar. 9, 2005. The entire contents of this Japanese Patent Application No. 2005-64744 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve apparatus for an internal combustion engine comprising a cylinder set comprising a plurality of cylinders, the variable valve apparatus comprising:

a control shaft adapted for movement;

a valve actuating mechanism provided for each cylinder of the cylinder set and adapted to vary a valve lift characteristic of an engine valve of each cylinder of the cylinder set in accordance with a position of the control shaft; and a valve lift adjusting mechanism provided for each cylinder of a first subset of the cylinder set and adapted to correct an error in the valve lift characteristic of the engine valve of each cylinder of the first subset in accordance with a standard valve lift characteristic determined in accordance with the valve lift characteristic of the engine valve of each cylinder of a second subset of the cylinder set.

2. The variable valve apparatus as claimed in claim 1, wherein the first subset of the cylinder set comprises a cylinder located nearest to one end of the control shaft and a cylinder located nearest to another end of the control shaft.

3. The variable valve apparatus as claimed in claim 2, wherein the second subset of the cylinder set is the complement of the first subset of the cylinder set, and wherein the second subset of the cylinder set comprises a cylinder located nearest to a central portion of the control shaft.

4. The variable valve apparatus as claimed in claim 1, wherein the second subset of the cylinder set is the complement of the first subset of the cylinder set.

5. The variable valve apparatus as claimed in claim 4, wherein the cylinder set consists of three cylinders, and wherein the first subset of the cylinder set consists of a cylinder located nearest to one end of the control shaft and a cylinder located nearest to another end of the control shaft.

6. The variable valve apparatus as claimed in claim 4, wherein the cylinder set consists of four cylinders, and wherein the first subset of the cylinder set consists of a cylinder located nearest to one end of the control shaft and a cylinder located nearest to another end of the control shaft.

7. The variable valve apparatus as claimed in claim 4, wherein the cylinder set consists of five cylinders, and wherein the first subset of the cylinder set consists of a cylinder located nearest to one end of the control shaft and a cylinder located nearest to another end of the control shaft.

8. The variable valve apparatus as claimed in claim 4, wherein the cylinder set consists of five cylinders, and wherein the second subset of the cylinder set consists of a cylinder located nearest to a central portion of the control shaft.

9. The variable valve apparatus as claimed in claim 4, wherein the cylinder set consists of six cylinders, and wherein the first subset of the cylinder set consists of a cylinder located nearest to one end of the control shaft and a cylinder located nearest to another end of the control shaft.

10. The variable valve apparatus as claimed in claim 4, wherein the cylinder set consists of six cylinders, and wherein the second subset of the cylinder set consists of two cylinders located nearest to a central portion of the control shaft.

11. The variable valve apparatus as claimed in claim 1, wherein the second subset of the cylinder set comprises a cylinder located nearest to an actuator for rotating the control shaft.

12. The variable valve apparatus as claimed in claim 1, further comprising a drive shaft adapted for rotation, the drive shaft having one end adapted to be driven by a crankshaft of the internal combustion engine, wherein the valve actuating mechanism is adapted to open and close the engine valve of each cylinder of the cylinder set in accordance with a rotational position of the drive shaft, and wherein the second subset of the cylinder set comprises a cylinder located nearest to the one end of the drive shaft.

13. The variable valve apparatus as claimed in claim 1, wherein the control shaft comprises a control cam for each cylinder of the cylinder set, wherein the valve actuating mechanism is adapted to vary the valve lift characteristic of the engine valve of each cylinder of the cylinder set in accordance with a rotational position of the control cam of the control shaft, and wherein the second subset of the cylinder set comprises a cylinder located nearest to one end of the control shaft.

14. The variable valve apparatus as claimed in claim 1, wherein the standard valve lift characteristic is intermediate among the valve lift characteristic of the engine valve of each cylinder of the second subset of the cylinder set.

15. The variable valve apparatus as claimed in claim 1, wherein the valve actuating mechanism of each cylinder of the complement of the first subset of the cylinder set comprises a high-speed valve lift adjusting element adapted to adjust a difference in the valve lift characteristic of the engine valve between each cylinder of the complement and the cylinders of the first subset while the internal combustion engine is running at a high speed.

16. The variable valve apparatus as claimed in claim 15, wherein the high-speed valve lift adjusting element is a weight adjusting element substantially identical in weight to the valve lift adjusting mechanism.

17. The variable valve apparatus as claimed in claim 15, wherein the high-speed valve lift adjusting element is a flexure adjusting element adapted to allow a flexure in the valve actuating mechanism of each cylinder of the complement to expand the valve lift characteristic of the engine valve of each cylinder of the complement.

18. The variable valve apparatus as claimed in claim 1, wherein the valve lift adjusting mechanism is arranged to be accessible from an upper opening of a cylinder head of the internal combustion engine.

19. The variable valve apparatus as claimed in claim 1, wherein the valve lift adjusting mechanism is arranged to be accessible from a front portion and a rear portion of the internal combustion engine.

20. The variable valve apparatus as claimed in claim 1, wherein the valve actuating mechanism comprises a swing cam adapted to open and close the engine valve of each cylinder of the cylinder set, and wherein the swing cams of the cylinder set are supported for rotation on a common shaft.

21. The variable valve apparatus as claimed in claim 1, wherein the valve actuating mechanism comprises:

a drive shaft adapted to be rotated by a crankshaft of the internal combustion engine;

a swing cam adapted for rotation; and a power transmitting mechanism converting a rotary motion of the drive shaft into a swinging motion of the swing cam, and wherein a state of conversion of the power transmitting mechanism varies in accordance with the position of the control shaft.

22. The variable valve apparatus as claimed in claim 1, wherein the valve actuating mechanism comprises:

a drive shaft adapted to rotate in synchronization with a crankshaft of the internal combustion engine;

a drive cam secured to the drive shaft;

a swing cam adapted for rotation, the swing cam having a cam surface in sliding contact with an upper surface of a valve lifter of the internal combustion engine to open and close the engine valve;

a rocker arm having a first wing portion mechanically linked with the drive cam, and a second wing portion; and a link rod mechanically linking the second wing portion of the rocker arm and the swing cam, and wherein an axis of rotation of the rocker arm moves in accordance with the position of the control shaft.

23. The variable valve apparatus as claimed in claim 1, wherein the valve lift adjusting mechanism of each cylinder of the first subset provides a fixed correction in the valve lift characteristic of the engine valve of each cylinder of the first subset constantly during operation of the internal combustion engine.

24. A method for a variable valve apparatus for an internal combustion engine comprising a cylinder set comprising a plurality of cylinders, the variable valve apparatus comprising: a control shaft adapted for movement; a valve actuating mechanism provided for each cylinder of the cylinder set and adapted to vary a valve lift characteristic of an engine valve of each cylinder of the cylinder set in accordance with a position of the control shaft; and a valve lift adjusting mechanism provided for each cylinder of a first subset of the cylinder set and adapted to correct an error in adjust the valve lift characteristic of the engine valve of each cylinder of the first subset, the method comprising:

determining a standard valve lift characteristic in accordance with the valve lift characteristic of the engine valve of each cylinder of a second subset of the cylinder set;

correcting an error in the valve lift characteristic of the engine valve of each cylinder of the first subset in accordance with the standard valve lift characteristic; and adjusting a standard position of the control shaft in such a manner to vary the standard valve lift characteristic in accordance with a desired valve lift characteristic.

* * * * *